United States Patent [19]

Byrne

[11] Patent Number: 4,611,665

[45] Date of Patent: Sep. 16, 1986

[54] SPRINKLER HEAD VALVE MEANS

[75] Inventor: Barry F. Byrne, Killarney Heights, Australia

[73] Assignee: Wormald International Limited, Crows Nest, Australia

[21] Appl. No.: 652,826

[22] Filed: Sep. 20, 1984

[30] Foreign Application Priority Data

Sep. 27, 1983 [AU] Australia ..... PG1591

[51] Int. Cl.[4] ..... A62C 37/14

[52] U.S. Cl. ..... 169/37; 137/855

[58] Field of Search ..... 169/19, 20, 26, 37–42, 169/57–59, 90; 239/569; 137/852, 855–858, 72

[56] References Cited

U.S. PATENT DOCUMENTS

| | | | |
|---|---|---|---|
| 188,309 | 3/1877 | Smith | 137/858 |
| 338,609 | 3/1886 | Nysewander | 137/858 |
| 4,108,247 | 8/1978 | Mohler | 169/38 |
| 4,109,727 | 8/1978 | Job | 169/41 |
| 4,131,135 | 12/1978 | Aleff | 137/856 |

FOREIGN PATENT DOCUMENTS

| | | |
|---|---|---|
| 1592547 | 6/1970 | France . |
| 1404181 | 8/1975 | United Kingdom . |
| 1495907 | 12/1977 | United Kingdom . |

*Primary Examiner*—Andres Kashnikow

*Attorney, Agent, or Firm*—Ladas & Parry

[57] ABSTRACT

A valve for sealing closed the fluid supply orifice in a sprinkler head body, comprising a sealing plug having a projection extending axially towards the supply orifice when assembled on the body, a resilient membrane having an annular portion captured over the projection and for compression between the plug and the body to seal the supply orifice, and a tail portion attachable to the body, whereby upon jettisoning of the plug with opening of the supply orifice the plug remains attached to the body by the tail portion at least until the plug is clear of the fluid jet issuing from the orifice.

3 Claims, 5 Drawing Figures

SPRINKLER HEAD VALVE MEANS

The invention pertains to valved automatic sprinkler heads and more particularly to valving means therefor.

A conventional form of sprinkler head comprises a metal body having a threaded base for attachment to a pipeline and a valve opening therethrough which is surrounded by a seat on one side of the base. An integral overhanging frame supports a liquid disseminator confronting the valve opening and a thermally responsive element, in one form being a frangible bulb filled with alcohol or the like, presses a sealing plug onto the seat to close the valve opening. When the bulb disintegrates from internal pressure caused by temperature expansion of its contents the plug is jettisoned by the liquid pressure in the pipeline and liquid is sprayed in a predetermined pattern by the disseminator. The spray pattern is determined for effective coverage of the protected area.

However, so called "hang up" of the sealing plug sometimes occurs due to its being driven onto the underside of the overhanging frame, or disseminator, and becoming jammed. The predetermined spray pattern is destroyed.

It is the main object of the invention to provide valve means for automatic sprinkler heads which will alleviate this problem.

According to the invention, in one general form, there is provided valve means for sealing closed the fluid supply orifice in a sprinkler head body, comprising a sealing plug provided with a projection facing towards said orifice when said plug is assembled upon said body, and a resilient membrane having an annular portion positioned over said projection to capture said plug and serving to seal closed said orifice when compressed between said plug and said body and the membrane also having a tail portion on said annular portion attachable to said body to deflect said plug out of the path of a fluid jet issuing from said orifice when said orifice is opened.

The invention will be better understood with reference to the following description read in conjunction with the accompanying drawings, in which.

Figure 1:
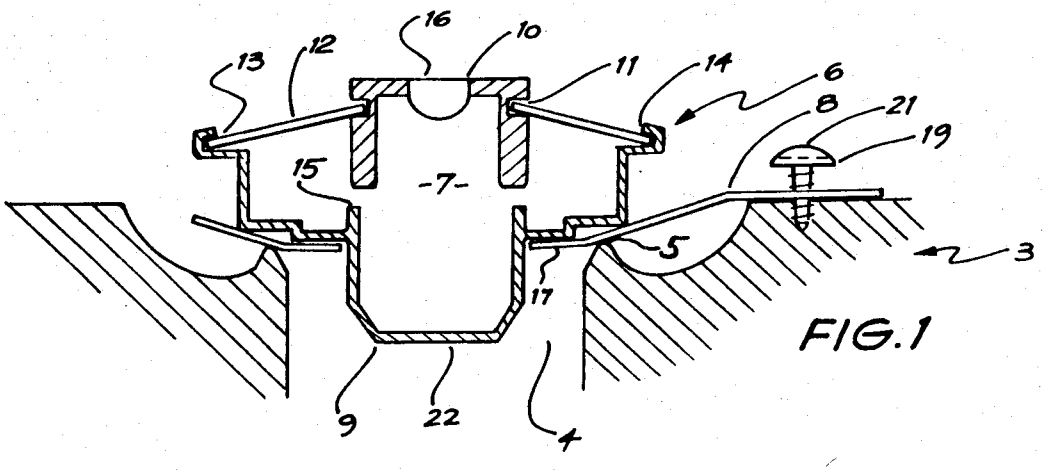
FIG. 1 shows in section valve means according to this invention about to be applied to a sprinkler valve seat.

The base 3 of an automatic sprinkler head is shown in FIG. 1 having a conventional valve orifice 4 surrounded by an annular valve seat 5. The valve means 6, of this invention, is shown about to be placed upon the seat 5 and consists of a sealing plug 7 and a flexible and resilient membrane 8. The plug 7 is shown as a metal shell but preferably is turned from solid metal rod. As shown it is composed of a hollow body 9 and cap 10 provided with a peripheral slot 11 to seat the inner rim of an annular spring member 12. The outer rim 13 of the member 12 is captured under an inturned peripheral lip 14 on the body 9. The cap 10 may be depressed by a conventional thermally-responsive element (not shown) against the tension of the spring member 12, and must not touch annular abutment 15. The thermally responsive element will be socketed within the cap recess 16.

Figure 2B:
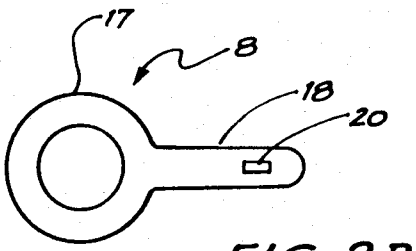
FIGS. 2A and 2B show two embodiments of a resilient membrane included in the valve means; and, FIGS. 3A and 3B show in longitudinal section and bottom plan, respectively, a third embodiment of the resilient membrane.
Figure 2A:
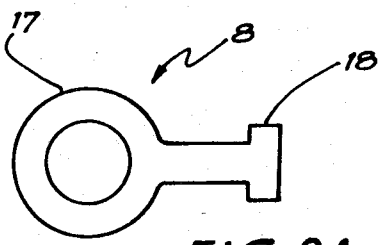

The membrane 8, preferably of silicone rubber or other suitable resilient and flexible material being either thermoplastic elastomeric or metallic, has, according to a first two embodiments, a flat annular sealing portion 17 and anchoring tail 18 as shown in FIG. 2A or FIG. 2B. The membrane 8 may be formed by moulding or it may be cut from sheet material. The tail 18 is intended to be anchored with respect to the base 3 of the sprinkler head and when a membrane 8 such as shown in FIG. 2B is used, an anchoring peg 19 is fixed in the base 3. A slot 20 is provided in the tail portion 18 to enable this portion to be anchored when pressed over the head 21 of the peg 19. The body 9 of the plug has an axially extending projection 22 over which the annulus 17 may be pressed to capture the membrane 8 to the plug 6. It will be noted that the annular sealing portion of the membrane 8 will be compressed by the seat 5 against the underside of the body 9 of the plug 6 when the spring is placed under tension by the cap 10. Through the resiliency of the membrane 8 good sealing between the seat 5 and the underside of the plug body 9 will be achieved in order to seal closed the orifice 4. Instead of the anchoring post 19 a slotted post may be provided to accept an enlarged end of the tail portion 18 of the membrane 8 which is shown in FIG. 2A.

The automatic sprinkler head will become activated to spray fire fighting liquid via a jet from the orifice 4 when the frangible bulb (not shown) fractures. The pressure at the orifice 4 will jettison the sealing plug 6 and due to its attachment to the membrane 8 it will be caused to arch away from the liquid stream by rotating about the anchoring peg 19. This thereby ensures against "hang-up" of the sealing plug occurring in such a manner as to destroy the spray pattern of liquid as predetermined by the disseminator on the sprinkler head body.

Figure 3A:
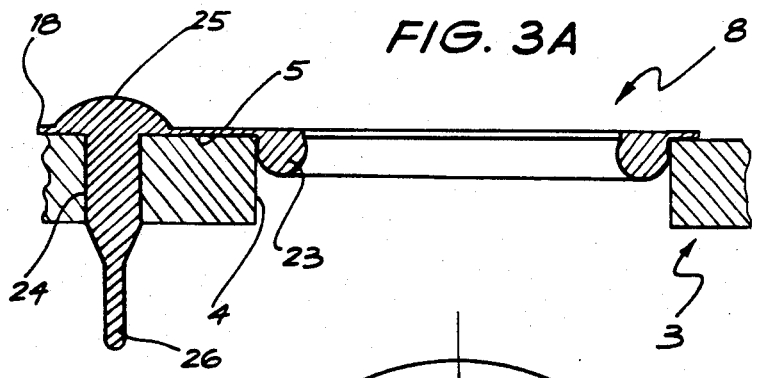
Figure 3B:
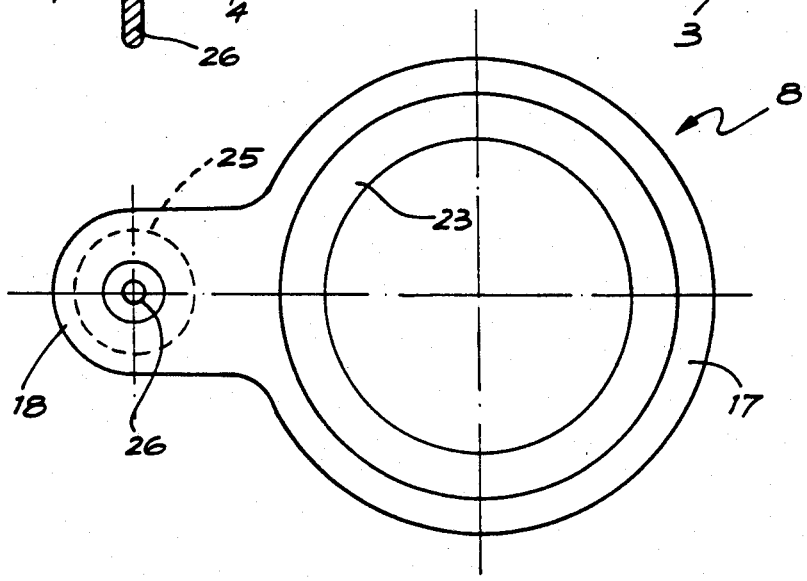

A further embodiment of the invention is illustrated in FIGS. 3A and 3B, where similar numerals relate to like parts of the above described embodiments of FIGS. 2A and 2B. In this instance the sprinkler head base 3 has a flat annular valve seat 5 and the annular sealing portion 17 of the membrane 8 includes a depending integrally formed O-ring 23 which is arranged to be a close fit within the valve orifice 4 to assist in sealing. Furthermore, a hole 24 is provided through the base 3 for snug fitting of an integrally formed tag 25 on the tail 18 of the membrane 8. A thin teat 26 is provided on the tag 25 to enable it to be pulled through the hole 24 and subsequently trimmed, if desired. The membrane will be located over the projection 22 of the plug 7 (FIG. 1) and will function as described previously with respect to the former embodiments.

Whereas several preferred embodiments have been described in the foregoing passages it should be understood that other forms and modifications are possible within the scope of this invention.

What I claim is:

1. Valve means for sealing closed the fluid supply orifice in a sprinkler head body, comprising a sealing plug provided with a projection facing towards said orifice when said plug is assembled upon said body, and a resilient membrane having an annular portion positioned over said projection to capture said plug and serving to seal closed said orifice when compressed between said plug and said body and the membrane also having a tail portion on said annular portion attachable to said body to deflect said plug out of the path of a fluid jet issuing from said orifice when said orifice is opened, and a depending O-ring being integrally formed on said annular portion of the resilient membrane said O-ring having a diameter for close fitting within said orifice to assist in sealing closed said orifice.

2. Valve means according to claim 1, wherein an anchoring tag is integrally formed with said tail portion for close fitting within a hole in said body.

3. Valve means for maintaining closed the fluid supply orifice of a sprinkler head body, and comprising a sealing plug operable to engage a valve seat on said body to close the orifice and having a projection confronting the orifice, and a moulded resilient membrane havinq an annular portion and integral O-ring captured over said projection and compressible between said plug and said body with said O-ring a press fit within the orifice for liquid sealing between the plug and the body, said membrane also having tail portion integrally formed with said annular portion for anchoring to said body, whereby with opening of the orifice the pluq is held at least temporarily by said membrane against force of a fluid jet issuing from the orifice to deflect the plug out of said jet.

* * * * *